United States Patent [19]

Brown

[11] Patent Number: 4,705,085

[45] Date of Patent: Nov. 10, 1987

[54] INFLATABLE BEVERAGE INSULATOR

[76] Inventor: Dwight C. Brown, 504 Live Oak, Pasadena, Tex. 77506

[21] Appl. No.: 806,537

[22] Filed: Dec. 9, 1985

[51] Int. Cl.[4] ..... B65D 23/08; B65D 25/34; B65D 65/02

[52] U.S. Cl. ..... 220/400; 206/522; 215/12.1; 220/903; 383/3

[58] Field of Search ..... 150/52 R; 206/522; 383/3; 220/903, 85 H; 251/344, 353, 343; 137/223; 215/13 R, 12 A; 229/1.5 H

[56] References Cited

U.S. PATENT DOCUMENTS

| | | | |
|---|---|---|---|
| 1,182,042 | 5/1916 | Rubin | 150/52 R |
| 1,548,241 | 8/1925 | Anderson | 137/223 |
| 1,927,471 | 9/1933 | Salomon | 383/3 X |
| 2,482,322 | 9/1949 | Cortese | 150/52 R X |
| 2,715,231 | 8/1955 | Marston | 206/522 X |
| 2,729,259 | 1/1956 | Abrams | 150/52 R |
| 3,319,685 | 5/1967 | Urban | 150/52 R |
| 3,523,563 | 8/1970 | Mirando | 383/3 X |
| 3,883,053 | 5/1975 | Pritchard et al. | 206/522 X |
| 3,987,736 | 10/1976 | Miller | 206/522 X |
| 4,164,970 | 8/1979 | Jordal | 206/522 X |
| 4,574,953 | 3/1986 | Garbuzov | 206/522 |

FOREIGN PATENT DOCUMENTS

| | | | |
|---|---|---|---|
| 704493 | 2/1954 | United Kingdom | 383/3 |
| 738440 | 10/1955 | United Kingdom | 150/52 R |

*Primary Examiner*—William Price
*Assistant Examiner*—Sue A. Weaver
*Attorney, Agent, or Firm*—Glaser, Griggs & Schwartz

[57] ABSTRACT

An inflatable beverage insulator for receiving a beverage container for keeping the beverage container in a thermally protected environment, including a container receptacle for receiving the beverage container with such container receptacle including a jacket portion and a base portion formed integrally therewith, with the jacket portions and base portions forming a pneumatically secure cavity which, by means of inflating members, permits the inflation of the cavity to permit the thermal insulation of the beverage container so disposed in the container receptacle.

2 Claims, 5 Drawing Figures

INFLATABLE BEVERAGE INSULATOR

FIELD OF THE INVENTION

The present invention relates to a beverages insulator of the type for receiving a beverage container therein for keeping the beverage container in a thermally protected environment.

BACKGROUND OF THE INVENTION

Inflatable devices have long been used in a wide variety of applications. Examples of such applications include utilization as a inflatable pad such as shown in U.S. Pat. No. 3,883.053, buoyant articles such as shown in U.S. Pat. No. 2,715,231, protective packing structures as shown in U.S. Pat. No. 2,449,591, pneumatic dunnage devices as shown in U.S. Pat. No. 3,987,736, and even an inflatable bag as shown in U.S. Pat. No. 4,164,970.

However, no inflatable device is known disclosing an inflatable beverage insulator that provides a unitary, collapsible device wherein the beverage insulator is capable of being formed in a unitary structure with a jacket portion and base portion, which may be selectively inflated and deflated by the user.

SUMMARY OF THE INVENTION

The present invention relates to a new and improved beverage insulator for receiving a beverage container for keeping the beverage container in a thermally protected environment. Preferably, the beverage insulator includes a container receptacle having an integrally formed jacket and base portions, each having an interior surface and an exterior surface forming a pneumatically secure cavity, with an inflating mechanism with the container receptacle for permitting the inflation of the cavity.

DESCRIPTION OF THE PREFERRED EMBODIMENT

The inflatable beverage insulator of the present invention is designated generally with the letter I. The inflatable beverage insulator I is generally useful for receiving a beverage container 10 for keeping the beverage container 10 in a thermally protected environment as discussed more fully hereinbelow. The inflatable beverage insulator I generally includes a container receptacle R for receiving the beverage container 10, with the container receptacle R including a jacket portion J and a base portion B, with the container receptacle R further forming a penumatically secure cavity C. Inflating means M is formed with the container receptacle R for permitting inflation of the cavity C. Unless otherwise delineated, it is preferred that the components of the inflatable beverage insulator I be formed of suitable flexible, plastic and/or rubber materials capable of withstanding the pneumatic pressures involved yet being generally economical in cost and easy to work with.

Figure 2:
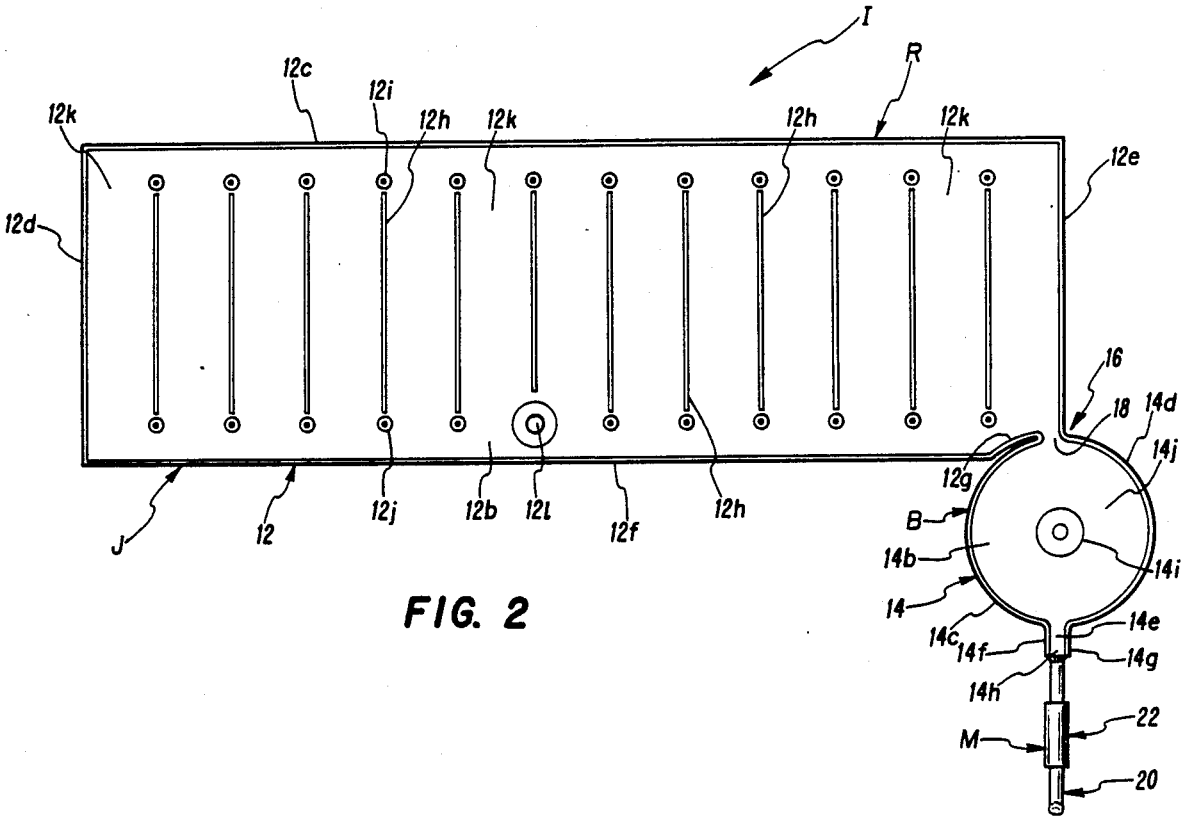
FIG. 2 is a plan view of the layout of the inflatable beverage insulator of the present invention, prior to the final assembly.
Figure 3:
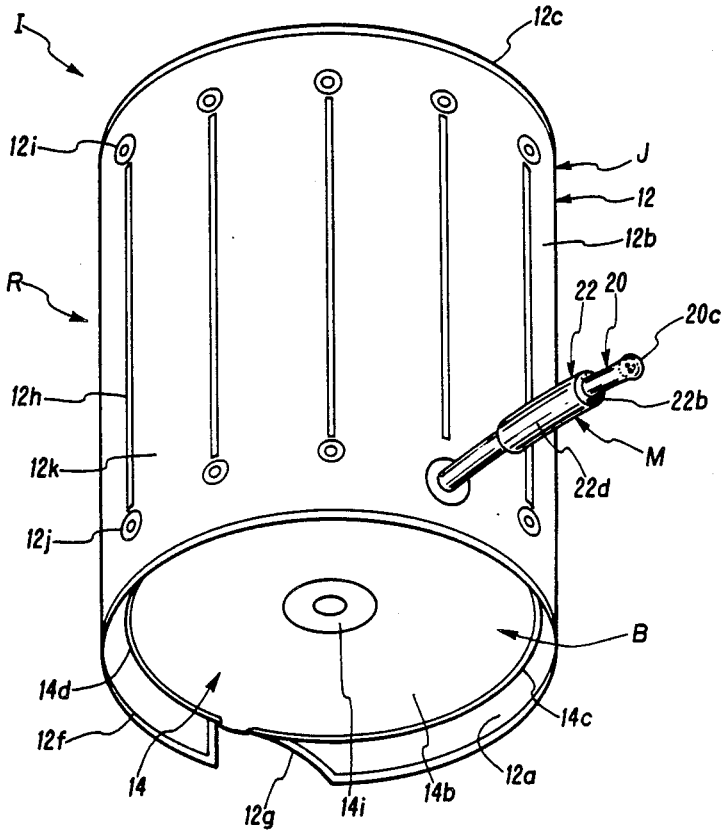
FIG. 3 is an isometric view of the assembled inflatable beverage insulator of the present invention, with the inflatable beverage insulator in a non-inflated posture.

The inflatable beverage insulator I of the present invention includes generally a container receptacle R for receiving the beverage container 10. The container receptacle R includes a jacket portion J and a base portion B. The jacket portion J of the container receptacle R includes a jacket 12 which is best seen in FIGS. 2 and 3. The jacket 12 includes an interior surface 12*a* and an exterior surface 12*b*. The interior and exterior surfaces 12*a*, 12*b* of the jacket 12 are joined along top edge 12*c*, side edges 12*d*, 12*e* and bottom edge 12*f* as well as at inset edge 12*g* in a pneumatically sealable arrangement. The joining of the interior and exterior surfaces 12*a*, 12*b* may be by any suitable process including welding, gluing, melting or in any other fashion for joining the preferably plastic materials forming the interior surface 12*a* and exterior surface 12*b* of the jacket 12.

In like fashion, the base portion B includes base 14 which is of a generally circular configuration and is integrally formed with the jacket 12 at base connection 16. The base connection 16 is formed at the joinder of the jacket 12 and base 14 adjacent to inset edge 12*g*. Preferably, the base 14 includes an interior surface (not shown) and an exterior surface 14*b* which are joined to one another about the circular edge 14*c* in a pneumatically sealable configuration. Preferably, a pneumatic passageway 18 is formed adjacent to base connection 16, adjacent connection of the inset edge 12*g* with the circular edge 14*c* and similar connection of the side edge 12*e* with circular edge 14*d*. A suitable mounting neck 14*e* is formed adjacent to the juncture of circular edges 14*c*, 14*d* adjacent the perimeter of the generally circular base 14 of the base portion B substantially 180° apart from the pneumatic passageway 18. The mounting neck 14*e* is preferably formed by edges 14*f*, 14*g* formed with circular edges 14*c*, 14*d*, respectively, in a pneumatically sealable arrangement forming a cavity 14*h* within the mounting neck 14*e*. Preferably, suitable pneumatic stress relief 14*i* may be formed with the base 14. As such, the interior surface (not shown) and exterior surface 14*b* are suitably affixed together by suitable weldments, melting and the like in order to form a doughnut-shaped penumatic cavity 14*j* within the base 14.

The jacket 12 of the jacket portion J preferably includes a plurality of ribs 12*h* having suitable pneumatic stress reliefs 12*i*, 12*j* formed adjacent each end of such ribs 12*h*, such that the pneumatic stress reliefs 12*i*, 12*j* help to prevent separation of the ribs 12*h*. Preferably, the ribs 12*h* are generally parallel to one another and are adpated to be aligned along the longitudinal axis of the beverage insulator I. Preferably, cellular compartments 12*k* are formed between the adjacent ribs 12*h* and between the interior and exterior surfaces 12*a*, 12*b*. The jacket portion J of the container receptacle R further includes a mounting neck opening 121 suitably formed adjacent the bottom edge 12*f* and approximately equidistant between side edges 12*d*, 12*e* as discussed more fully hereinbelow.

The inflatable beverage insulator I of the present invention further includes inflating means M formed with the container receptacle R for permitting the inflation of the inflatable beverage insulator I of the present invention. More particularly, the inflating means M is preferably mounted with the mounting neck 14*e* of the base 14 of the base portion B. The inflating means M includes an inflating tube 20 mountable with the container receptacle R and valve means 22 with the inflating tube 20. Preferably, the inflating tube 20 is generally of a cylindrical configuration having an inner surface 20*a* defining a cylindrical cavity 20*b*. As the inflating tube 20 is preferably formed of a suitable plastic material, the end portion 20*c* is preferably closed by gluing, welding, melting, or the like so as to form a pneumatically leakproof closure adjacent such end portion 20*c*. The inflating tube 20 further includes exterior surface 20*d*, with an inflating orifice 22*a* formed in the inflating tube 20 extending between the exterior surface 20*d* through the inner surface 20*a* thus permitting communication through the inflating orifice 22*a* with the cavity 20*b* within the inflating tube 20. Preferably, the inflating tube 20 is joined with the mounting neck 14*e* of the base 14 adjacent edges 14*f*, 14*g* such that the cavity 14*h* of the base pneumatically communicates with the cavity 20*b* of the inflating tube 20. The inflating tube 20 may be suitably affixed with the mounting neck 14*e* by suitable weldment 24, which may include glue, adhesive, liquid plastic and/or the like in order to insure a pneumatically secure mounting of the inflating means M with the mounting neck 14e.

Figure 4:
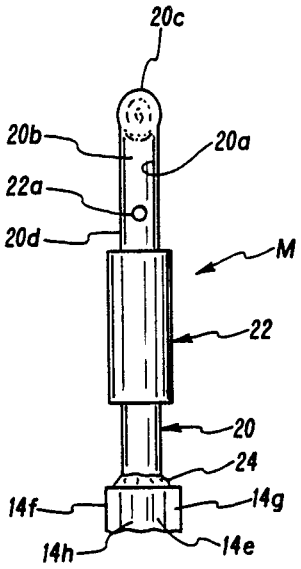
FIG. 4 is close-up detail of the inflating means of the present invention, detailing the valve means in an open position.
Figure 5:
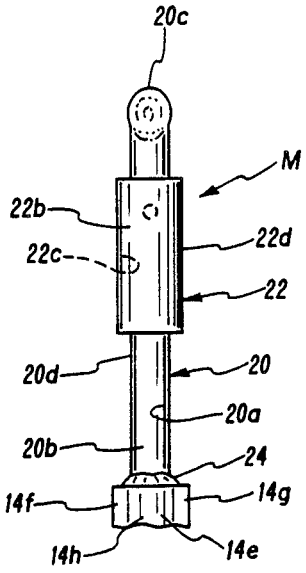
FIG. 5 is a detail of the inflating means of the present invention, detailing the valve means in a closed position.

The valve means 22 of the inflatable beverage insulator I of the present invention includes the inflating orifice 22*a* and a valve sleeve 22*b*. The valve sleeve 22*b* is preferably formed having a generally cylindrical configuration with an inner surface 22*c* and an exterior surface 22*d*. Preferably, the valve sleeve 22*b* is adapted to be mountable in a sealable relationship with the inflating tube 20 such that the inner surface 22*c* of the valve sleeve 22*b* is in a pneumatically secure relationship with the exterior surface 20*d* of the inflating tube 20. Preferably, the valve sleeve 22*b* is adapted to be slided along the inflating tube 20 such that it is movable from a first position wherein the inflating orifice 22*a* is exposed (as shown in FIG. 4) to a second position wherein the valve sleeve 22*b* covers the inflating orifice 22*a* (FIG. 5). As such, when the valve sleeve is in the first position, the inflating orifice 22*a* is exposed to permit the ingress or egress of air into or from, respectively, the container receptacle R. More specifically, by forcing air into the inflating orifice 22*a*, air fills the cavity 20*b* within the inflating tube, is thereafter forced into cavity 14*h* within the base 14, into cavity 14*j* in base 14, through pneumatic passageway 18 thereinto and about the cellular compartments 12*k* in the jacket 12 for inflation of the beverage insulator I to a suitable pressure. Conversely, if the inflatable beverage insulator I is already pneumatically filled, by exposing the inflating orifice 22*a* (as shown in FIG. 4) the air from within the inflatable beverage insulator I will be allowed to escape from the cavity C outwardly therefrom by exiting from and through the inflating orifice 22*a*. As shown in FIG. 5, with the valve sleeve 22*b* positioned such that the inflating orifice 22*a* is covered, the ingress or egress of air to or from the cavity C of the container receptacle R is prevented. As will be appreciated, the cavity C of the inflatable beverage insulator I of the present invention includes the cellular compartments 12*k*, and adjoining areas, pneumatic passageway 18, cavity 14*j*, cavity 14*h*, and cavity 20*b*.

In the assembly of the inflatable beverage insulator I of the present invention, it is preferred that side edges 12*d*, 12*e* be suitably affixed to one another by welding, gluing or the like. Thereafter, the inflating tube 20 is inserted through the mounting neck opening 121 formed in jacket 12 and pulled through tot he extent that the mounting neck 14e of the base 14 extends through the mounting opening 121, with the inflating tube 20 extending outwardly therefrom. A suitable retaining collar may be slipped over the inflating tube 20 to prevent the mounting neck 14e from becoming detached from the mounting neck opening 121. Thereafter, the valve sleeve 22*b* may be slipped over the inflating tube 20.

Figure 1:
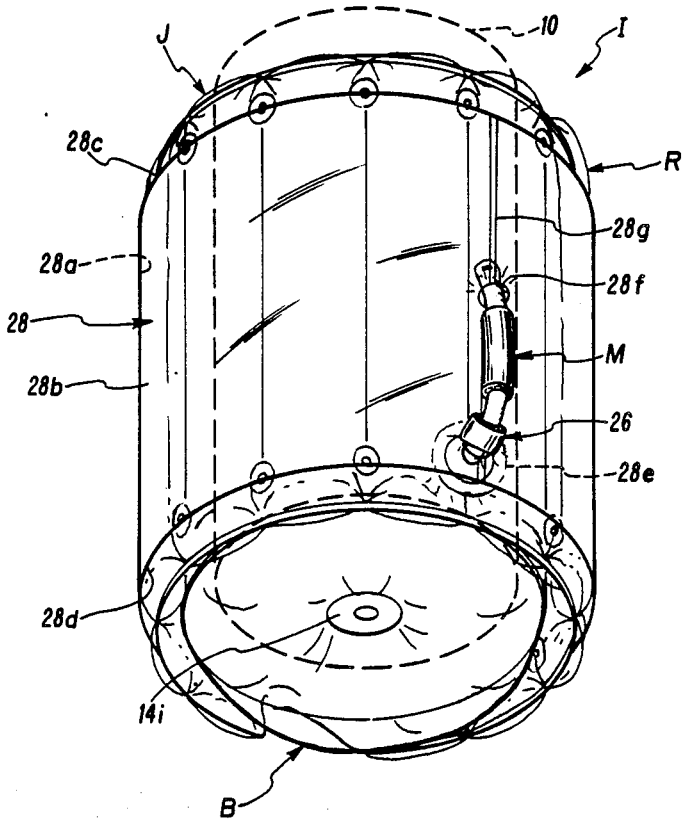
FIG. 1 is an isometric view of the inflatable beverage insulator of the present invention, showing the inflatable beverage insulator in a fully inflated posture.

The inflatable beverage insulator I of the present invention may further include a outer sheath 28 (FIG. 1) which preferably includes an inner surface 28*a*, an outer surface 28*b*, an upper edge 28*c* and lower edge 28*d*. Preferably, the outer sheath 28 is designed so that it may be slipped about the exterior surface 12*b* of the jacket 12 of the jacket portion J and provide protection to the exterior surface 12*b* of the jacket 12 from punctures and the like. The cylindrical length of the outer sheath 28 is preferably less than that of the jacket portion J, with the outer sheath 28 being formed having a suitable valve opening 28*e* formed therewith and adapted to be alignable with the mounting neck opening 121 such that the inflating tube 20 may extend not only through the mounting neck opening 121 but also through the valve opening 28*e* formed in the outer sheath 28. Furthermore, it is preferred that a valve locating opening 28*f* be formed with the outer sheath in proximity to valve opening 28*e* for receiving the inflating tube 20 to selectively locate the inflating tube 20, in a protective position with the end portion 20*c* of the inflating tube 20 being located between the inner surface 28*a* of the outer sheath 28 and the exterior surface 12*b* of the jacket 12 for securing the inflating tube 20 therebetween. The valve locating opening 28*f* may be used for securing the inflating tube 20 between the inner surface 28*a* and exterior surface 12*b* when the beverage insualtor I is either in an inflated or deflated position.

It will be appreciated that the outer sheath 28 not only provides a protective covering for the jacket portion J of the inflatable beverage insulator I but also provides a place for printed matter. It will be appreciated that the valve opening 28*e* provides a suitable securing means for securing the outer sheath 28 with the container receptacle R to prevent the outer sheath 28 from becoming removed therefrom. Furthermore, the pneumatic stress relief items such as 14*i*, and 12*i*, help to prevent the buildup of pneumatic stresses, thus reducing the chance of separation of welded seams and the like and further limit the pneumatic expandability in areas adjacent thereto.

In the filling operation of the inflatable beverage insulator I of the present invention, the valve sleeve 22*b* is preferably positioned in the first position as shown in FIG. 4 such that the inflating orifice 22*a* is exposed. Thereafter, the user places the inflating orifice 22*a* in the user's mouth, sealing such with the user's lips tightly fitted about the inflating orifice 22*a*. The cavity C is inflated by forcing air into the cavity C to pneumatically pressurize the beverage insulator I as described hereinabove. After inflating the insulator I to the desired pressure, it is preferred that the teeth of the user be used to pull the valve sleeve 22*b* from its first position of FIG. 4 to the second, closed position of FIG. 5, thus covering the inflating orifice 22*a* and preventing pneumatic leakage thereof. To deflate the insulator I, the user need only slide the valve sleeve 22*b* from covering the inflating orifice 22*a*, whereinafter such may be collapsed.

As noted above, variations in materials may be used in construction of the beverage insulator I of the present invention. For example, jacket portion J and base portion B may be formed of a vinyl film while the inflating tube 20 may be formed of polyethylene tubing and the valve sleeve 22*b*, formed of surgical tubing. Other possible materials may include mylar, polypropylene, and polyurethane. While various types of gluing and welding techniques may be used, some of which may include actual softening and chemical bonding of the material, other types of electro-welding and ultrasonic bonding processes work well in the manufacture of items made of various plastic materials, as is well known in the art. It should be further appreciated that the inside diameter of the beverage insulator I may be varied by adjusting air pressure within the cavity C. Furthermore, by deflating the beverage insulator I when not in use, the beverage insulator I may be stored in a folded position in a small area.

In the manufacture of the beverage insulator I of the present invention, it is preferred that the jacket portion J with attached base portion B are formed from two layers of material forming the interior surface 12*a*, the interior surface of base portion B (not shown) and exterior surfaces 12*b*, 14*b*, respectively, which are suitably bonded together adjacent edges 12*c*, 12*d*, 12*e*, 12*f*, 12*g*, 14*c*, 14*d*, 14*f*, 14*g*. Preferably, a metal dye (not shown) is utilized for cutting about the perimeter of the integrally formed container receptacle R such that the two layers forming the interior and exterior surfaces are fed from a dialectric welding machine (not shown), for example, through the rollers whereinafter the machine welds and cuts such. Thereafter, this unit is removed from the sheet. The side edges 12*d*, 12*e*, of the jacket 12 must be subsequently overlapped and thereafter bonded to complete formation of the jacket portion J. At this point, it is preferred that the mounting neck 14*e* be squared off, to the extent necessary, to permit the mounting of the inflating tube 20 therewith. Preferably a metal rod (not shown) is inserted through the inflating tube 20 to be connected to the mounting neck 14*e*, with the inflating tube 20 being partially inserted into the cavity 14h whereinafter a suitable welding process is effectuated to secure the inflating tube 20 with the base portion B by means of weldments 24. Thereafter, a suitable blank material (not shown) is placed into cavity 20b of inflating tube 20 whereinafter the inflating orifice 22*a* is punched through one wall of the tube 20 into the blank material, thus insuring the formation of the orifice 22*a* as is preferred. Alternatively, two inflating orifices 22*a*, each 180° apart from the other, may be formed in tube 20 by merely removing such blank material at the time the orifice 22*a* is punched, as may be desired. Thereafter, the valve sleeve 22*b* is dipped in a suitable lubricating solution and slid over the inflating tube 20 such that the valve sleeve 22*b* is in a position such as that shown in FIG. 4. Thereafter, the end portion 20*c* of the inflating tube 20 is suitably welded closed. Thereafter, it is preferred that the outer sheath 28 be formed by suitably sizing the length of the sheath 28 and thereafter bonding the end portions along seam 28*g* in a fashion similar to that of ends 12*d*, 12*e* of the jacket portion J. Of course, if it is desired to print any material/instructions on the outer sheath 28, such should be done prior to the bonding process. Preferably simultaneous with the bonding of the outer sheath 28, the openings 28*e*, 28*f* are formed. Thereafter, it is preferred that the inflating tube 20, complete with valve means 22, is thereafter slid through the mounting neck opening 121 such that the mounting neck 14*e* is properly positioned in such opening with the mounting neck further extending through opening 28*e* in he outer sheath. A suitable retaining ring 26 may be placed about the mounting neck 14*e*, as discussed above, in order to prevent its removal from the mounting neck opening 121. Thereafter, the the mounting neck 14*e*, as discussed above, in order to prevent its removal from the mounting neck opening 121. Thereafter, the beverage insulator I is fully inflated and checked for leaks to insure that all welds, seams, laps and the like are properly secure.

As such, the inflatable beverage insulator I of the present invention results in a reusable, collapsible device that may be used to maintain a beverage container 10 (which may be a can, bottle, or glass) at its desired temperature, be it warm or cold and further to prevent the user's hands from feeling uncomfortably hot or cold while holding the beverage container 10. Not only does the inflatable beverage insulator I serve to protect the beverage container 10, it also helps to protect surfaces where the beverage container 10 might otherwise be placed. For example, it is not uncommon for cold drinks to "sweat" or have condensation associated with them, leaving undesirable water marks which may damage a surface where the beverage container 10 is placed; alternatively, the beverage container 10 itself may scratch or in some other manner damage the associated surface. By utilizaation of the inflatable beverage insulator I of the present invention, such defects are minimized. Furthermore, in view of the fact that the inflatable beverage insulator I fits about the beverage container 10, such helps to enhance the overall size of the beverage container 10, less susceptible to tipping and thus more stable. When not in use, the inflatable beverage insulator I may be fully emptied of all air and collapsed for ease of storage. It should be appreciated that a snug fit may be achieved with beverage cntainers 10 of varying diameter merely by varying the amount of air within the cavity C of the inflatable beverage insulator I. For example, tapering containers can be accommodated because of air displaced by the wide portion of such a tapering container may move to the narrow portions. Furthermore, due to the wide variety of materials that the inflatable beverage insulator I may be made from, the insulator I may be made of a transparent material and/or translucent material to reveal the status of the fluid contents within the beverage container 10 as such is being consumed. In addition, because the inflatable beverage insulator I includes a base portion B, the insulating characteristics of such are further enhanced.

Thus, the beverage insulator I of the present invention provides a new and improved insulator for receiving a beverage container and maintaining such in a thermally protected environment.

The foregoing disclosure and description of the invention are illustrative and explanatory thereof, and various changes in the size, shape and materials, as well as the details of the illustrated construction may be made without departing from the spirit of the invention.

What is claimed is:

1. An inflatable beverage insulator for receiving a beverage container for keeping the beverage container in a thermally protected environment, comprising, in combination:

a container receptacle for receiving the beverage container, said container receptacle including a jacket portion;

said jacket portion formed in a generally cylindrical configuration for receiving the beverage container therein;

said container receptacle having an interior surface and an exterior surface, said interior surface and said exterior surface being joined together to form a pneumatically secure cavity;

an inflation tube mounted on said container receptacle, said tube having a closed end, an open end and an inflation passage disposed between said closed and open ends, said inflation tube being connected in pneumatic communication at its open end with said cavity and having an inflation orifice formed intermediate said closed and open ends for permitting ingress and egress of air into and out of said inflation passage, respectively;

a sleeve disposed in slidable, sealing engagement about said inflation tube, said sleeve being movable from a first position wherein said inflation orifice is exposed to permit the ingress or egress of air into or from said inflation passage, respectively, to a second positon wherein said sleeve covers said inflation orifice in sealing relationship to prevent the ingress or egress of air into or from aid inflation passage, respectively; and an outer sheath adapted to be disposed about said container receptacle for protecting said exterior surface of said container receptacle.

2. The inflatable beverage insulator of claim 1, further including:

securing means coupling said outer sheath to said container receptacle, said outer sheath having an inner surface; and, a valve locating opening formed therein for receiving said inflation tube to selectively locate said inflation tube in a protective position partially between said inner surface of said outer sheath and said exterior surface of said container receptacle.

* * * * *